US007914361B1

(12) United States Patent
Morris et al.

(10) Patent No.: US 7,914,361 B1
(45) Date of Patent: Mar. 29, 2011

(54) ENTERTAINMENT APPARATUS AND METHODS PROPELLING TOY VEHICLES ABOUT MULTIPLE TRACKS

(75) Inventors: LaMont Morris, Cumberland, RI (US); Douglas A Schultheis, Cumberland, RI (US); Mark Foster, Cumberland, RI (US)

(73) Assignee: Hasbro, Inc., Pawtucket, RI (US)

( * ) Notice: Subject to any disclaimer, the term of this patent is extended or adjusted under 35 U.S.C. 154(b) by 730 days.

(21) Appl. No.: 11/742,985

(22) Filed: May 1, 2007

(51) Int. Cl.
*A63H 18/00* (2006.01)

(52) U.S. Cl. ..... 446/444; 446/236; 446/168

(58) Field of Classification Search ..... 446/236, 446/444, 332, 429, 168–171
See application file for complete search history.

(56) References Cited

U.S. PATENT DOCUMENTS 1,524,615 A * 1/1925 Diederichs ..... 446/332
1,704,012 A * 3/1929 Marx ..... 446/332
1,778,038 A * 10/1930 Parke ..... 446/332
2,066,239 A * 12/1936 Tahsler ..... 446/236
2,602,262 A * 7/1952 Nichols ..... 446/445
3,514,108 A * 5/1970 Sidney et al. ..... 463/68
3,531,119 A * 9/1970 Bonanno ..... 463/68
3,948,520 A * 4/1976 Barlow ..... 463/68
4,041,873 A 8/1977 Jones
4,209,935 A * 7/1980 Parker ..... 463/64
4,237,648 A * 12/1980 Moe et al. ..... 446/332
4,395,041 A 7/1983 Goldfarb et al.
5,376,037 A * 12/1994 Finkbeiner ..... 446/236
5,452,893 A * 9/1995 Faulk et al. ..... 446/444
5,657,856 A * 8/1997 von Froreich ..... 198/817
5,791,253 A 8/1998 Schultheis et al.

* cited by examiner

*Primary Examiner* — Alvin A Hunter
*Assistant Examiner* — Urszula M Cegielnik
(74) *Attorney, Agent, or Firm* — Perry Hoffman

(57) ABSTRACT

An entertainment apparatus and methods propelling toy vehicles about multiple tracks providing a variety of play modes while mechanically driven by a single motor and simple belt sub-system. A motor and a plurality of adjacent discs disposed in the same horizontal plane are mechanically engaged with the motor for rotating the discs simultaneously in the same direction. An object alternately engages each of the plurality of discs and at least one transition area is adjacent the plurality of discs and disposed in the same horizontal plane for facilitating the action of the object about the plurality of discs. One or more objects are propelled about one or more tracks providing a variety of play modes.

18 Claims, 11 Drawing Sheets

ENTERTAINMENT APPARATUS AND METHODS PROPELLING TOY VEHICLES ABOUT MULTIPLE TRACKS

BACKGROUND OF THE INVENTION

1. Field of the Invention

The present invention relates to toys and more particularly to a toy capable of moving multiple objects back and forth about one or more tracks providing a variety of play modes while mechanically driven by a single motor and simple belt sub-system. The invention also relates to methods for playing the variety of action modes of the toy of the present invention.

2. Background of the Invention

There are a few known toys which include rotating discs for moving about a variety of objects. There are two or more discs included in the known toys and each disc rotates in the opposite direction of an adjacent disc so as to propel an object forward from the first disc to the last disc.

There are known toys which include rotating discs of different sizes and pockets defined on each disc for receiving a rolling object, such as a ball or marble. A user can have some control over the travel of a plurality of balls as they move continuously along the pockets defining predetermined paths and transfer from one disc to another where the paths interconnect.

The discs rotate in opposite directions and with enough centrifugal force such that the balls tend to move out of the pockets when a stop gate located between two adjacent discs is opened by the user. Each disc includes gear teeth around the periphery and the discs are rotated by a motor engaging a cog wheel for rotating the first disc of the gear train. Each adjacent disc is then rotated in an opposite direction to propel the plurality of balls forward.

There are also known toys which include turntables coupled together for rotation in opposite directions transferring a vehicle forward along a predetermined path which ends at a stationary track aligned with the predetermined path. The turntable systems is coupled to a cam and follower and driven for rotation by an engaged motor. The motor couples to the first turntable and through a connecting rod the first turntable causes the second turntable to rotate in an opposite direction.

Significantly, known toys which include rotating discs for moving about a variety of objects do not include discs rotating in the same direction or a plurality of discs each driven for rotation through engagement with a motor rather that another disc. Additionally, known toys do not include discs which move multiple objects back and forth about one or more tracks mechanically driven by a single motor and simple belt sub-system. It would be desirable to provide a plurality of adjacent discs rotating simultaneously in the same direction and defining one or more tracks for playing a variety of action modes.

SUMMARY OF THE INVENTION

The present invention addresses shortcomings of the prior art to provide a toy apparatus including a plurality of discs rotating simultaneously in the same direction and capable of moving one or more objects about in a variety of play modes. A plurality of adjacent discs mechanically driven by a single motor and simple belt sub-system are disposed in the same horizontal plane and rotate in the same direction for moving multiple objects back and forth about one or more tracks providing a variety of play modes.

In one embodiment of the invention, the toy apparatus includes a motor and a plurality of adjacent discs mechanically engaged with the motor for rotating the discs simultaneously in the same direction. The plurality of discs are disposed in the same horizontal plane, and in a further embodiment, the apparatus further includes an object to alternately engage each of the plurality of discs.

In another embodiment, the apparatus further includes at least one transition area adjacent the plurality of discs and disposed in the same horizontal plane, and in another embodiment, the plurality of discs include first and second discs each mounted on a vertical axis and being the same size. The first disc defines a first track and the second disc defines a second track both capable of alternately engaging the object, and in another embodiment, first and second tracks include a textured surface.

In another embodiment, the object further includes a plurality of wheels coupled to the object for rolling along at least a part of the first and second tracks and providing lateral movement to the wheels for easier passage over the transition area. In still another embodiment, a third track is defined on one of the first or second discs, such that the third track engages the object separately from the first and second tracks.

In a further embodiment, the plurality of discs define a first track and further include another object spaced apart from the first object moving independently about the first track, and in yet another embodiment, a further included stationary object is propelled to move about the first track by the first object.

In another embodiment, a method of playing with a toy apparatus includes providing a motor and a plurality of discs disposed in the same horizontal plane mechanically engaged with the motor. Rotating the plurality of discs in the same direction and providing an object moving alternately about the plurality of discs. In another embodiment the method further provides a belt drive sub-system mechanically engaged between the motor and the plurality of discs.

In another embodiment, the method further provides at least one transition area disposed between the plurality discs and in the same horizontal plane facilitating the action of the object about the plurality of discs. In another embodiment, the method further provides another object stationary on the transition area propelled by the first object, and in still another embodiment, the method further provides a plurality of wheels coupled to each of the first and second objects and providing lateral movement to the wheels for easier passage over the transition area.

In still another embodiment, a textured surface is further provided on the transition area for initially holding the second object stationary at the transition area and secondarily holding the first object stationary at the transition area after the first object has propelled the second object onto the plurality of discs. In a further embodiment, a textured surface is provided on at least a part of the first track.

In a further embodiment, the method further provides a second track wholly contained on one of the plurality of discs, and in another embodiment, another object moving about the second track independent of the first object is further provided. In still another embodiment, the method further provides a textured surface on at least a part of the second track facilitating the action of the second object about the second track.

Briefly summarized, the present invention relates to a toy apparatus including a plurality of adjacent discs disposed in the same horizontal plane, rotating in the same direction and mechanically driven by a single motor and simple belt sub-system. The toy apparatus of the present invention is capable of propelling one or more objects back and forth about a plurality of tracks providing a variety of play modes where the objects are capable of both moving independently of each other and also interacting with each other.

BRIEF DESCRIPTION OF THE DRAWINGS

For the purpose of facilitating an understanding of the inventions, the accompanying drawings and description illustrate a preferred embodiment thereof, from which the inventions, structure, construction and operation, and many related advantages may be readily understood and appreciated.

DESCRIPTION OF THE PREFERRED EMBODIMENTS

The following description is provided to enable those skilled in the art to make and use the described embodiments set forth in the best modes contemplated for carrying out the inventions. Various modifications, however, will remain readily apparent to those skilled in the art. Any and all such modifications, equivalents, and alternatives are intended to fall within the spirit and scope of the present invention.

Figure 1:
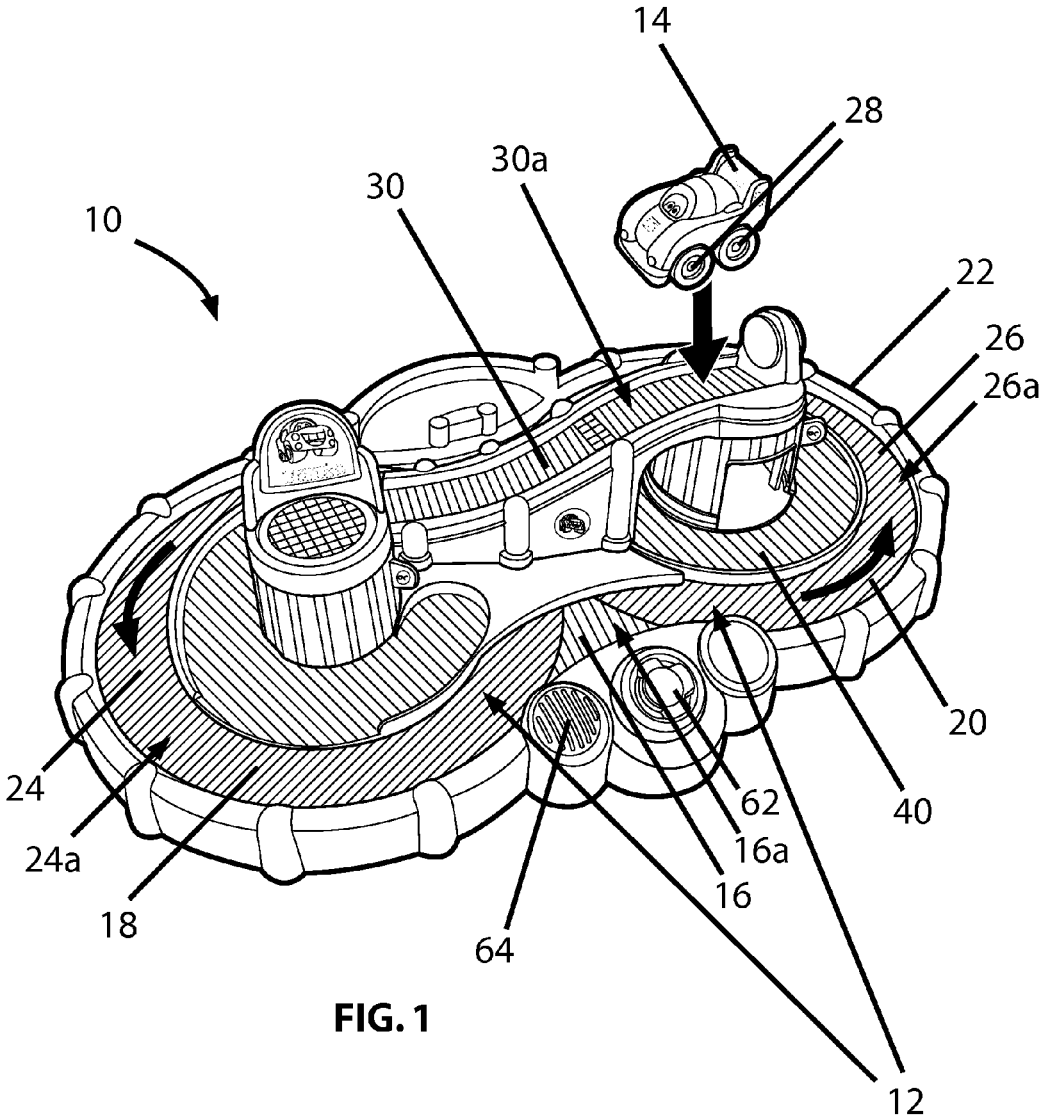
FIG. 1 is a perspective view of a toy apparatus of the present invention illustrating a plurality of discs.

A toy apparatus 10, as seen in FIG. 1, generally includes a plurality of discs 12, disposed within the same horizontal plane capable of rotating in the same direction and defining one or more tracks for an object to move about providing a variety of play modes. In the present described embodiment, a motor mechanically engages the plurality of adjacent discs 12, disposed in the same horizontal plane, for rotating the discs simultaneously in the same direction.

An object 14 alternately engages each of the plurality of discs 12, and at least one transition area 16, as seen in FIG. 1, is disposed between the plurality of discs 12 within the same horizontal plane for facilitating the action of the object 14 about the plurality of discs. The plurality of discs 12, as seen in FIG. 1, includes a round first disc 18 adjacent a round second disc 20 each the same diameter and each mounted on a vertical axis coupled to a base 22. It is also contemplated that more that two discs may be included and likewise, that the two or more discs may also vary in diameter.

First disc 18 defines a first track 24 and adjacent second disc 20 defines a second track 26. First track 24 includes a textured surface 24*a* and similarly, second track 26 includes a textured surface 26*a*, as seen in FIG. 1, such that both textured surfaces 24*a* and 26*a* facilitate the action of the object 14 about at least one of the first and second tracks. Likewise, transition area 16 includes a textured surface 16*a* for facilitating the action of the object 14 about the first and second tracks.

In the present described embodiment, the object 14, as seen in FIG. 1, is shaped to look like an animated race car including a plurality of wheels 28 coupled to the object 14 for rolling along at least a part of one of the first and second tracks 24 and 26, respectively. The plurality of wheels 28 includes two sets of adjacent wheels loosely coupled to the object 14 through adjacent axels providing lateral movement to the wheels for easier travel about the first and second tracks 24 and 26 and easier passage over the transition area 16. The object 14 can include any number of alternative shapes such as a bus, truck, or airplane including any number of wheels, sized to travel along at least part of at least one of the first and second tracks.

Additionally, object 14 includes a weight contained therein for helping to maintain the object 14 on the track as it travels about between the plurality of discs and over the transition area. The weighted object 14 also better maintains an upright position, as seen in FIG. 2, with the plurality of wheels 28 ridding along the track.

Figure 2:
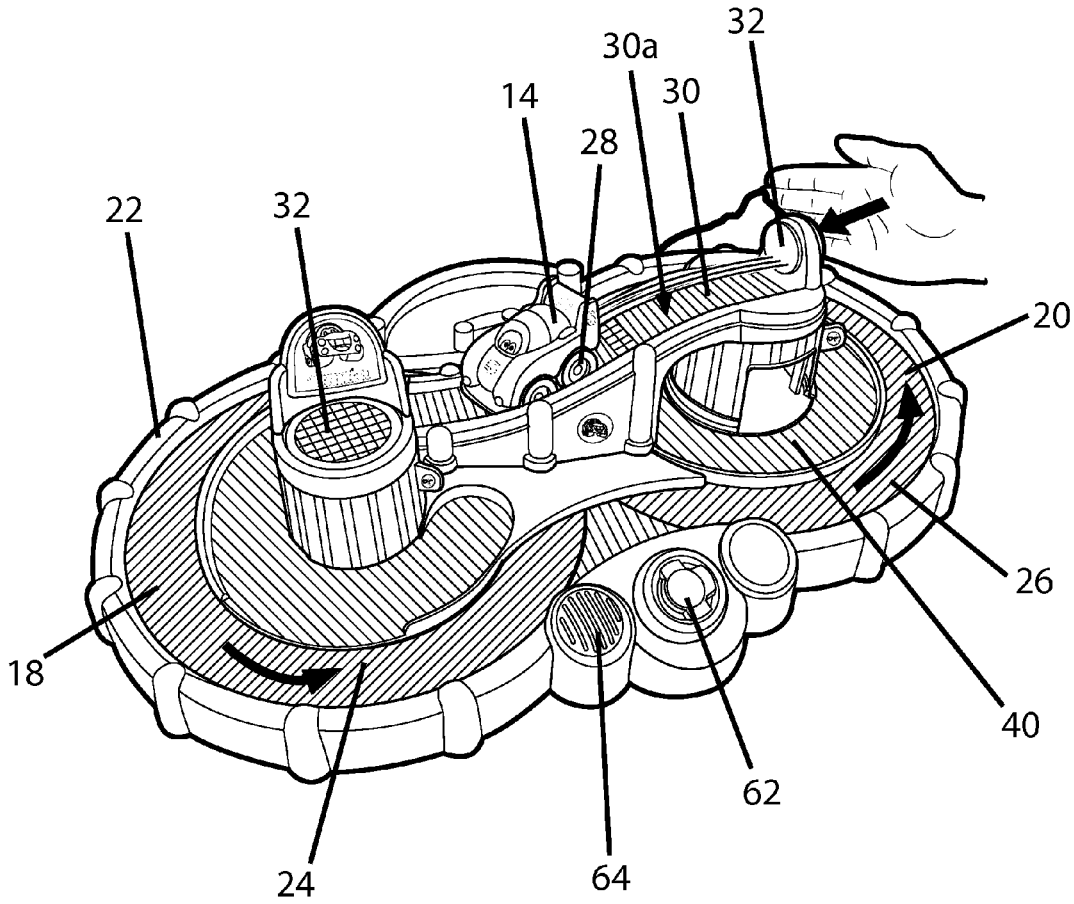
FIG. 2 is a perspective view of the apparatus illustrating an object on the track.

In the present described embodiment, a ramp 30, as seen in FIG. 2, is coupled to the base 22 and provides a platform from which the object 14 can be transported to the first and second tracks. The ramp 30 includes a textured surface 30*a* to provide surface friction or resistance to help prevent the plurality of wheels 28 from slipping on the ramp 30. As the object 14 travels down the ramp 30, the rotating first track 24 will capture the object and propel it forward in the rotating direction. Additionally, a ramp bumper 32, as seen in FIG. 2, can be hit or whacked sending the object down the ramp 30 and onto the first track 24 at an increased speed, further adding to the excitement of the toy 10.

Also, in the present described embodiment, a winner's circle platform 32 is coupled to the base 22, as seen in FIG. 2, concentric with the first disc 18. The platform 32 adds interest and further variety to the toy 10, and allows a user to perch the object 14 atop the platform 32. Additionally, the base of the platform 32 and the base of the ramp 30 each include a storage chamber 34 and attached sliding door 36, capable of wholly containing the object 14 for storage and transporting of the apparatus 10.

Figure 3A:
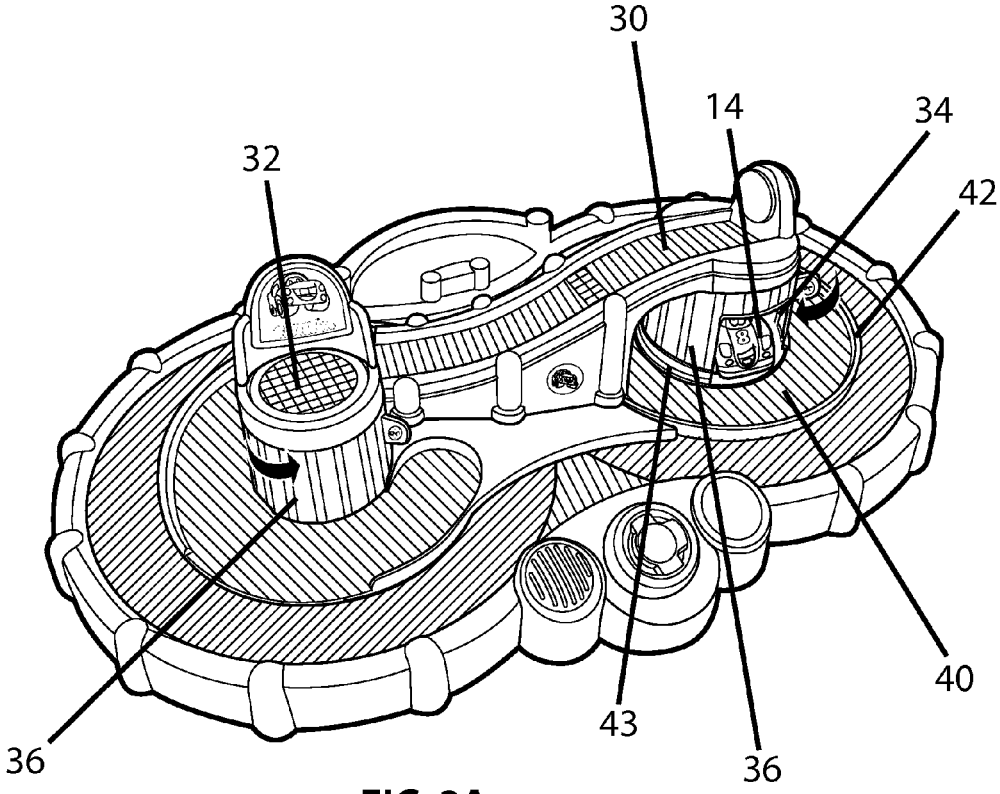
FIG. 3A is a perspective view of the apparatus illustrating a ramp and storage chambers.
Figure 3B:
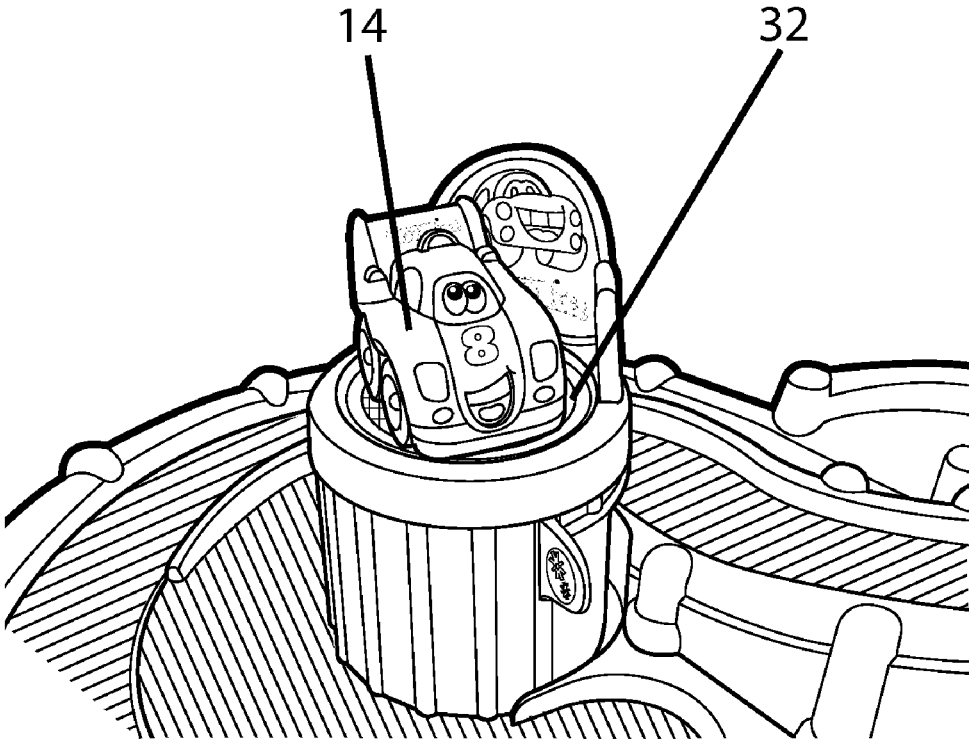
FIG. 3B illustrates a winner's circle platform.
Figure 4:
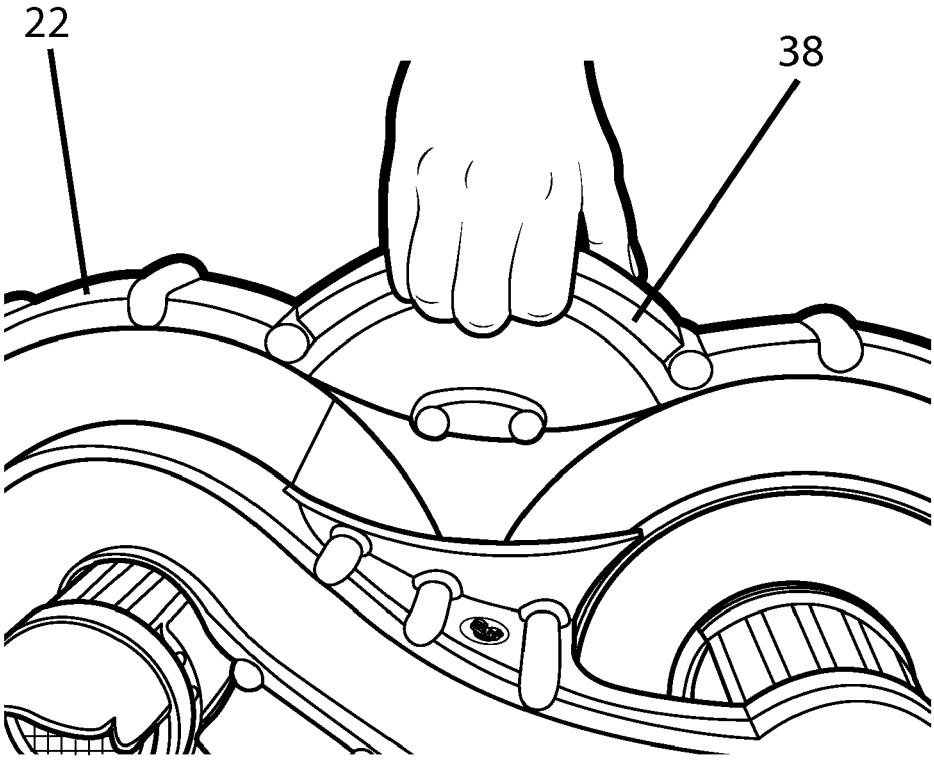
FIG. 4 illustrates a handle for transporting the apparatus.

As seen in FIG. 3, the storage chamber 34 beneath the platform 32 is shown with the sliding door 36 closed, and the storage chamber 34 beneath the ramp 30 is shown with the sliding door 36 open and containing the object 14. To further aid in the transporting of the apparatus, a handle 38, as seen in FIG. 4, is coupled to the base 22, or as in the present described embodiment, the handle 38 is integral with the base 22.

A third track 40, as seen in FIGS. 1-3, is defined on one of the first disc 18 or second disc 20 for engaging the object 14 separately from the first and second tracks 24 and 26, respectively. In the present described embodiment, a short wall 42 spans the outside perimeter of the third track 40, and a concentric ridge 43 spans the majority of the outside perimeter of the storage chamber 34 beneath the ramp 30, as seen in FIG. 3. The wall 42 and concentric ridge 44 can work together to wholly contain the object 14 on the third track 40 independent of the first or second tracks. The third track 40 further includes a textured surface 40*a*, as seen in FIG. 3, to facilitate the action of the object 14 about the third track.

The first, second, third, and transitional textured surfaces 24*a*, 26*a*, 40*a*, and 16*a* respectively, are shown as hatch marks as seen in FIGS. 1-3. Textured surfaces 24*a*, 26*a*, 40*a*, and 16*a* may include the same or different raised surface, or any combination thereof, with a regular pattern or an irregular configuration. Textured surfaces 24*a*, 26*a*, 40*a*, and 16*a* facilitate the actions of the one or more objects 14 traveling about these surfaces, by providing surface friction or resistance helping prevent the plurality of wheels 28 from slipping on these surfaces.

The plurality of discs 12 are better able to propel the object 14 about the one or more tracks because the textured surfaces 24*a*, 26*a*, 40*a*, and 16*a* will somewhat grip the plurality of wheels 28 and propel the object 14 along. This is especially apparent as the object 14 passes over the transition area 16 when traveling from the first track 24 to the second track 26. The transition area 16 does not spin and cannot propel forward the object 14 passing over the area 16 and instead, the spinning second track 24 pulls the object 14, with the help of textured surface 24*a*, onto the second track 24. Similarly, the textured surfaces 24*a*, 26*a*, and 40*a* may also permit the object 14, to ride stationary along at least a part of each of tracks 24, 26 and 40, by somewhat gripping the plurality of wheels 28 and momentarily stopping their rotation.

The plurality of discs 12 also define a first track 44, as seen in FIGS. 5A-D, and as described above, the discs 12 are mounted on base 22 such that a wall 46 of the base 22 extends above the discs 12 defining the outer perimeter of first track 44. Likewise, a ridge 48, incorporating a part of the short wall 42 defining the third track 40, forms the inner perimeter of the first track 44, as seen in FIGS. 5A-D. A break 50 in the inner perimeter of first track 44 allows the object 14 traveling down the ramp 30 to enter the first track 44.

Figure 5A:
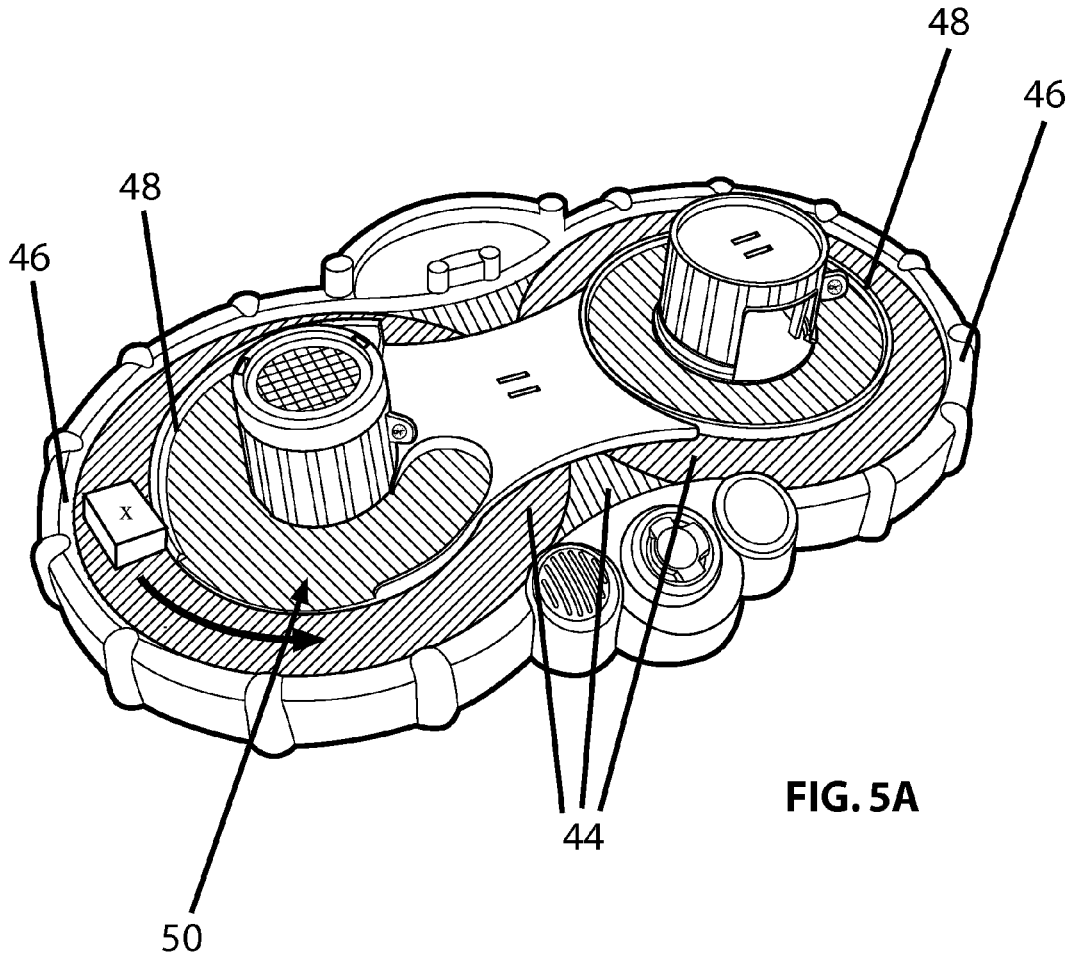
FIG. 5A illustrates object X traveling about a first track.
Figure 5B:
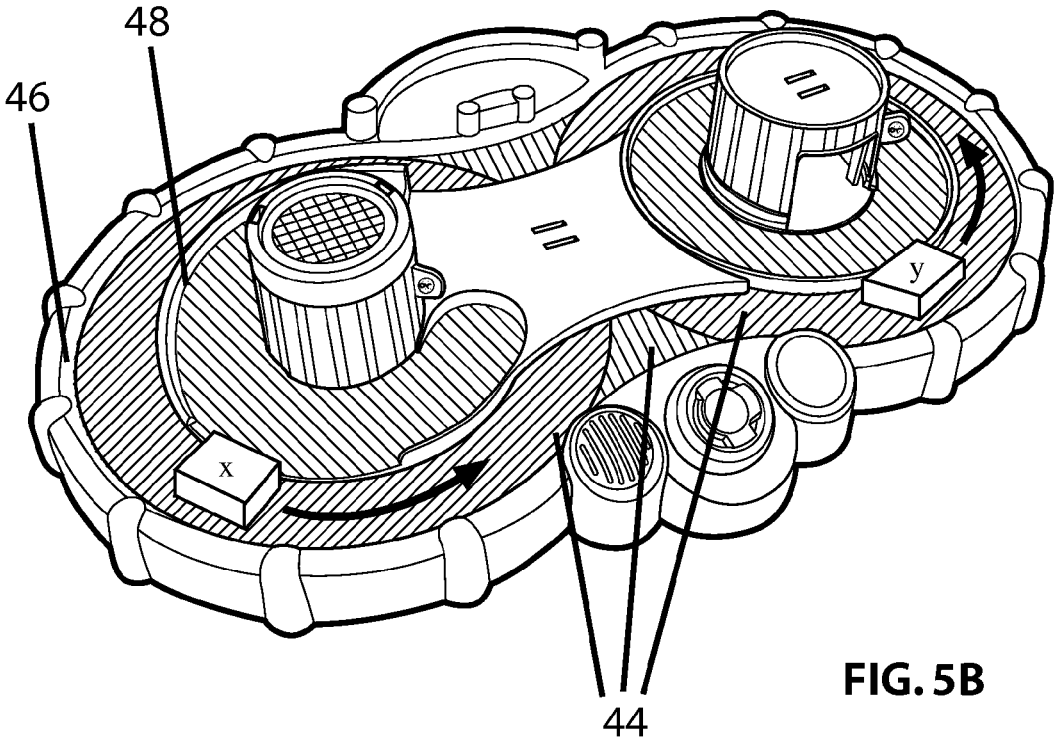
FIG. 5B illustrates object Y spaced apart from object X and traveling independently about the first track.

One or more objects 14 are capable of propelling back and forth about the first track 44, as the plurality of discs 12 are rotating, providing a variety of play modes where the objects 14 are capable of both moving independently of each other and also interacting with each other. A seen in FIG. 5A, object X travels about the first track 44 by itself and can be launched onto track 44 from ramp 30, as seen in FIG. 2, or placed by a user at any point on track 44, as seen in FIG. 5A. For an alternative play mode, another object Y, as seen in FIG. 5B, is added spaced apart from the first object X and travels about track 44 independent of object X.

Figure 5C:
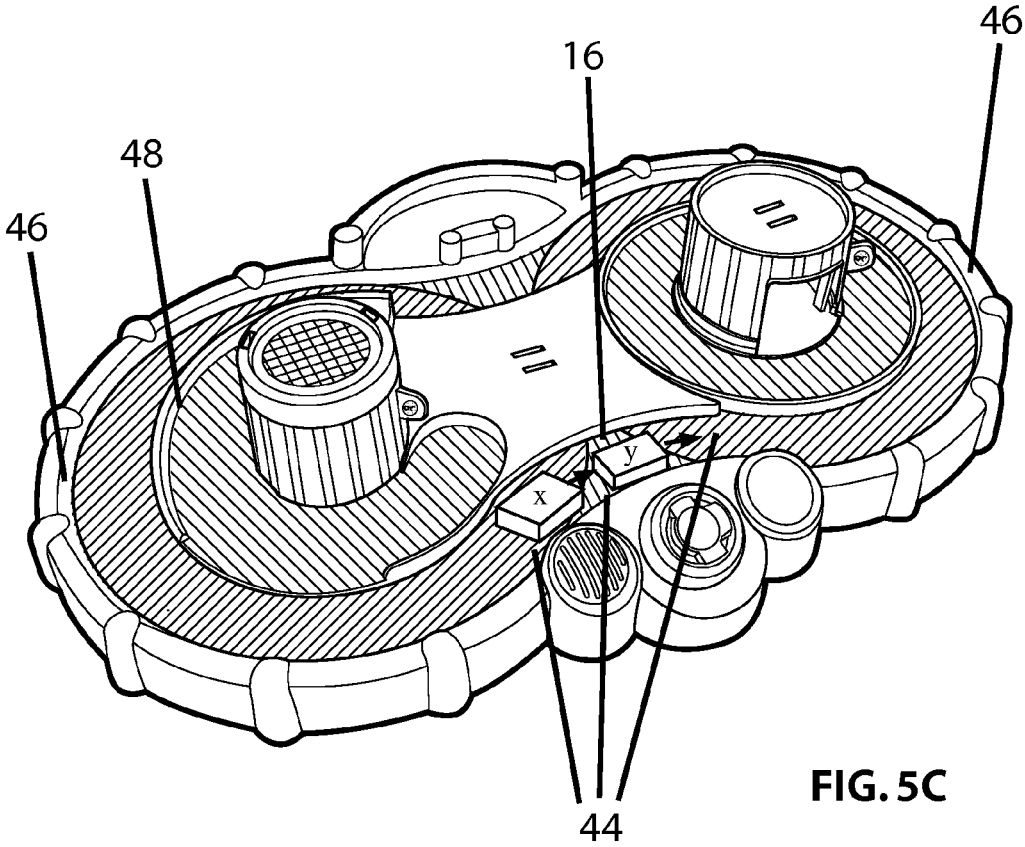
FIG. 5C illustrates stationary object Y at a transition area being propelled by object X.

For yet another alternative play mode, as seen in FIG. 5C, another object Y is stationary at transition area 16 of track 44 and propelled by first object X to travel about track 44. The textured surface 16*a* of the transition area 16 helps keep object Y stationary until object X contacts object Y propelling it along track 44. Additionally, the textured surface 16*a* helps keep object X stationary at the transition area 16 after object X propels object Y forward, and object X may remain at area 16 until object Y travels along track 44 and comes around to contact object X propelling it onto track 44. This cycle may be repeated over and over one or more times.

Figure 5D:
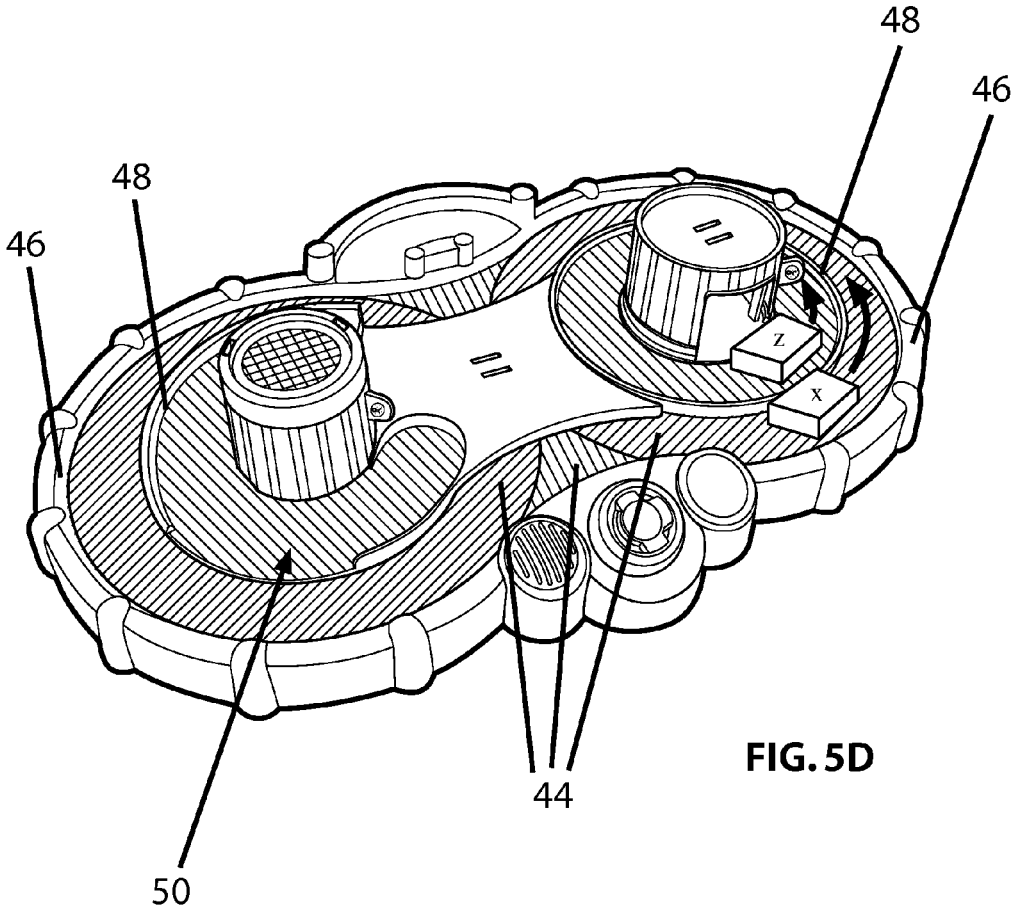
FIG. 5D illustrates object Z traveling about a third track completely independent of object X traveling about the first track.

Additionally, as seen in FIG. 5D, object Z can be included to travel along third track 40, as described above, at the same time object X travels about first track 44 with both objects Z and X completely independent of one another. The various play modes as described above, may be alternately combined together in any number of ways as desired by the user, to provide additional play modes.

Figure 6:
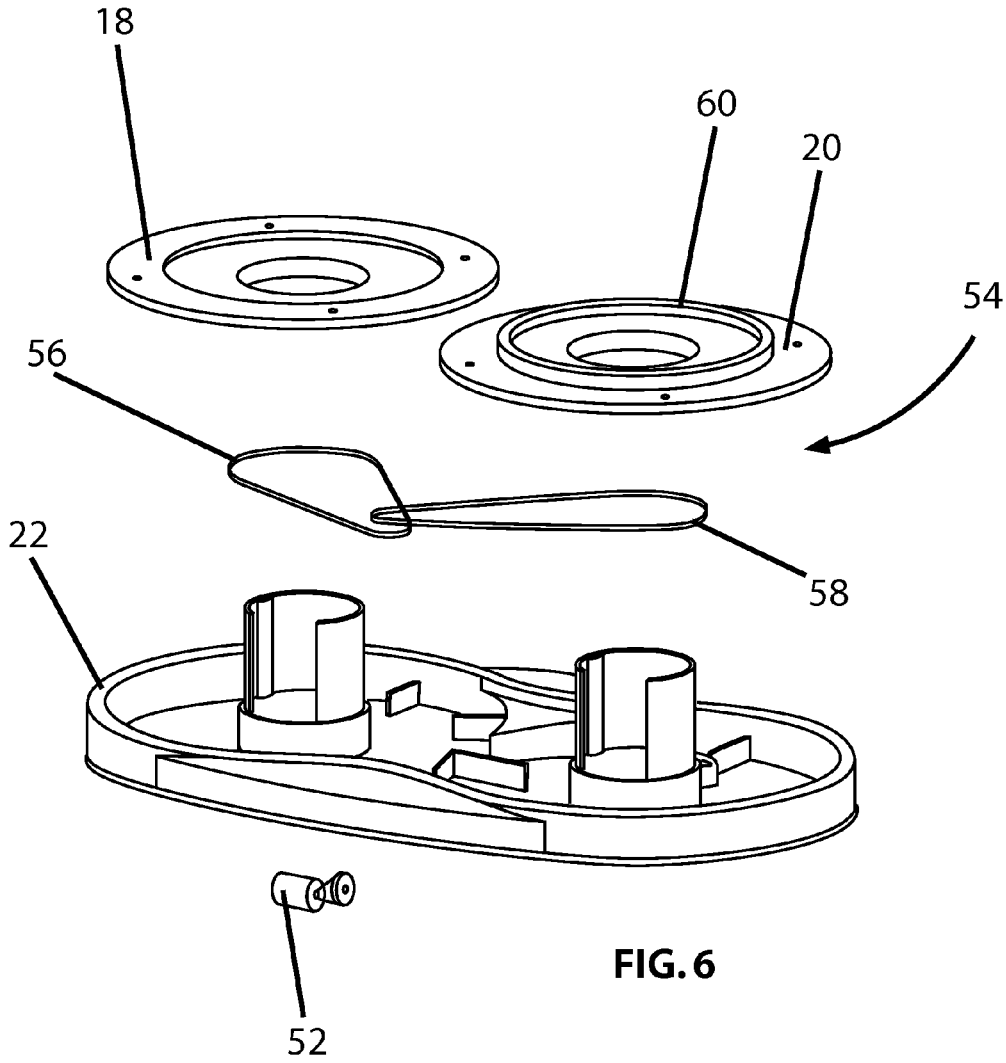
FIG. 6 illustrates a motor and belt sub-system for engagement with the plurality of discs.

The plurality of discs 12 are rotated in the same direction either clockwise or counter-clockwise. In the present described embodiment, first disc 18 and second disc 20, as seen in FIG. 6 mechanically engage motor 52 driving the rotation of discs 18 and 20 through a belt drive sub-system 54. The discs 18 and 20 are mounted on base 22, as described above, engaging the belt drive sub-system 54 also mounted on base 22. Belt 56 and belt 58 mechanically engage a lip 60 of discs 18 and 20, respectively, and also mechanically engage a shaft driven by the motor 52. As the shaft is rotated, belts 56 and 58 rotate discs 18 and 20, respectively, in the same direction. Similarly, the belt drive sub-system 54 will rotate discs 18 and 20 at the same speed.

The belt drive sub-system provides the benefit of rotating a plurality of discs off one motor and one shaft. Additionally, the belt drive sub-system helps to avoid breakage of the drive system by allowing the belts to slip on the shaft if a mechanical force is applied to one or both of the rotating discs momentarily stopping or slowing their rotation, such as if a user leans or presses on the rotating discs.

To further add fun and excitement to the one or more objects rotating about the one or more tracks, racing sounds and fast paced music play from a speaker 64, as seen in FIGS. 1 and 2, as the plurality of discs 12 are rotated. Additionally, a momentary button 62, as seen in FIGS. 1-3A and FIGS. 5A-5D, activates the rotating of the plurality of discs 12 and the racing sounds and music with a press of the button 62. The momentary button 62 is large and easy enough for a small child to activate over and over and plays for about ten seconds at a time. The apparatus 10 is battery operated including a port for loading batteries into the base 22, and can also include an on/off switch to prevent accidental activation of the rotating discs, and associated track sounds and music.

Figure 7:
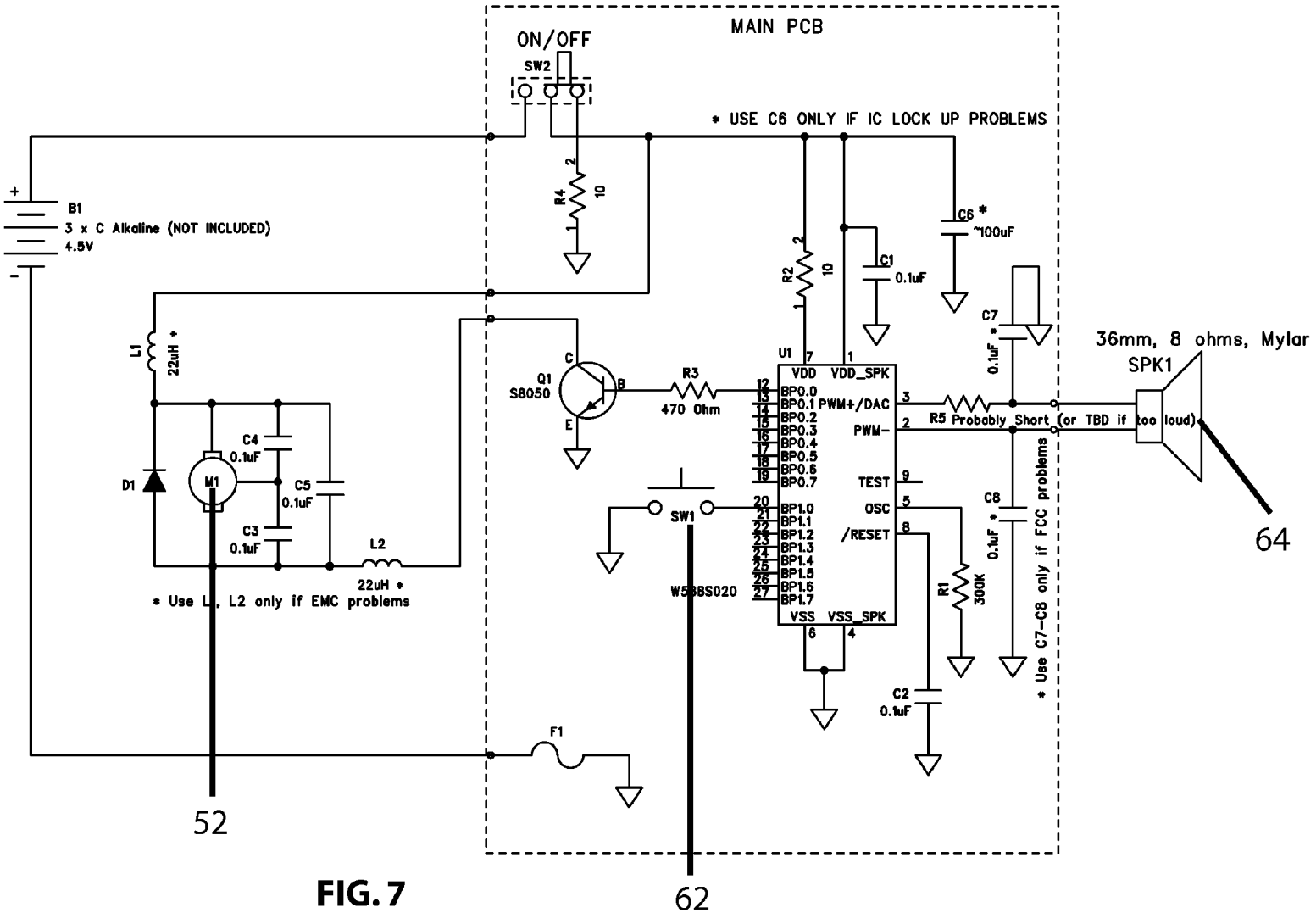
FIG. 7 is a schematic diagram showing the electrical circuitry of the apparatus.

The schematic diagram of the electrical circuitry of the apparatus 10, as seen in FIG. 7, provides an information processor such as a microprocessor or similar controller which is operable using the momentary button 62 turning on power to the motor 52 and providing various operations, sound, common music and/or speech audio output to a speaker 64. As described above the momentary button 62 activates the rotation of the plurality of discs and corresponding racing sounds and music and times out after ten seconds.

A method of playing with a toy apparatus includes providing a motor and a plurality of discs disposed in the same horizontal plane mechanically engaging the motor. Rotating the plurality of discs in the same direction and providing an object moving alternately about the plurality of discs. Further providing at least one transition area disposed between the plurality of discs in the same horizontal plane provides an area where another stationary object can be propelled by the first object.

Further providing a plurality of wheels coupled to each of the first and second objects for rolling along at least a part of the plurality of discs and providing a textured surface on the transition area for initially holding the second object stationary and secondarily holding the first object stationary at the transition area after the first object propels the second object onto the plurality of discs. Further providing lateral movement to the plurality of wheels eases the objects passage over the transition area.

The plurality of discs further provide a first track and a textured surface provided on at least a part of the first track facilitating the action of one or more objects about the first track, including rolling one or more objects along at least part of the first track. A second object is further provided and spaced apart from the first object moving about the first track independently of the first object.

The method further provides a second track wholly contained on one of the plurality of discs, and another object moving about the second track independent of the first object. A textured surface on at least a part of the second track is provided facilitating the action of the second object about the second track. The method of playing with a toy apparatus of the present described inventions allows one or more objects to propel back and forth about the first and/or second track, providing a variety of play modes where the objects are capable of both moving independently of each other and also interacting with each other.

From the foregoing, it can be seen that there has been provided a unique entertainment apparatus for moving multiple objects about one or more tracks providing a variety of play modes while mechanically driven by a single motor and simple belt sub-system. While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A toy apparatus, comprising:

a motor;

a plurality of discs disposed in the same horizontal plane mechanically engaging the motor and defining at least one track;

an object for traveling along the at least one track;

at least one transition area adjacent the plurality of discs disposed in the same horizontal plane and including a textured surface for facilitating the action of the object about the at least one track; and a second transition area disposed adjacent the plurality of discs in the same horizontal plane, said object comprising a plurality of wheels for facilitating the action of the object about the plurality of discs, said object further provided to travel and alternately engage the plurality of discs.

2. The apparatus according to claim 1, wherein the plurality of discs comprise first and second discs each mounted on a vertical axis and being the same size, wherein the first disc defines a first track and the second disc defines a second track both capable of alternately engaging said object.

3. A toy apparatus, comprising:

a first disc mounted on a first vertical axis, the first disc defining at least a first track thereon in a horizontal plane;

a second disc mounted on a second vertical axis disposed in the same horizontal plane with the first disc, wherein the first and second discs are the same size with the second disc defining at least a second track thereon;

a motor mechanically engaging both the first disc and the second disc for rotating each simultaneously in the same direction;

a wheeled object for traveling along the first track, each of said first track and said second track being positioned for alternately engaging the wheeled object; and at least one transition area adjacent the plurality of discs and disposed in the same horizontal plane with the first and second discs, the at least one transition area further comprising a surface for facilitating the wheeled object to travel to and from the first track, said second object is stationary at said at least one transition area and thereafter propelled by said first object to move said second object from said at least one transition area, said first object and said second object traveling alternately on said first disc and thereafter on said second disc.

4. The apparatus according to claim 3, wherein said at least one transition area comprises a textured surface for facilitating said wheeled object to travel to and from the first track.

5. The apparatus according to claim 4, wherein said another object is provided for being spaced apart from said wheeled object, and for moving independently about the first track.

6. The apparatus according to claim 5, wherein said wheeled object is a first wheeled object with said another object comprising a second wheeled object for moving about the first track.

7. The apparatus according to claim 6, wherein said first and second tracks comprise a textured surface to facilitate the action of said first and second wheeled objects about at least one of the first and second tracks.

8. A toy apparatus, comprising:

a motor;

a first disc having a top surface;

a second disc having a top surface, said second disc being disposed in the same horizontal plane with said first disc and mechanically engaging the motor;

a first object comprising a plurality of wheels for traveling alternately on the top surface of said first disc and thereafter on the top surface of said second disc;

at least one transition area adjacent said first disc and said second disc for facilitating the traveling of said first object alternately on said first disc and thereafter on said second disc; and said at least one transition area being disposed in the same horizontal plane with the top surface of said first disc and the top surface of said second disc;

a second object comprising a plurality of wheels; wherein said second object is stationary at said at least one transition area and thereafter propelled by said first object to move said second object from said at least one transition area, said first object and said second object traveling alternately on said first disc, and thereafter on said second disc.

9. The apparatus according to claim 8, wherein said second object is stationary at said at least one transition area and thereafter propelled by said first object to move said second object from said at least one transition area.

10. The apparatus according to claim 9, wherein said at least one transition area comprises a textured surface where said second object is kept stationary.

11. The apparatus according to claim 8, further comprising a base wherein said first disc and said second disc are mounted on said base.

12. The apparatus according to claim 11, wherein said base comprises an outer wall which extends above said first disc and which extends above said second disc along an outer perimeter of said first disc and said second disc.

13. The apparatus according to claim 12, comprising a first track defined on the top of the first disc, and comprising a second track defined on the top of the second disc.

14. The apparatus according to claim 13, wherein the outer wall of said base defines an outer perimeter of said first track and said second track.

15. The apparatus according to claim 8, comprising a first track defined on the top of the first disc, and comprising a second track defined on the top of the second disc.

16. The apparatus according to claim 13, comprising a second transition area adjacent said first disc and said second disc, and in the same horizontal plane with the top surface of said first disc and the top surface of said second disc.

17. The apparatus according to claim 16, wherein said transition areas comprise textured surfaces.

18. The apparatus according to claim 17, wherein the outer wall of said base defines an outer perimeter of said first track, an outer perimeter of said second track, and an outer perimeter of said textured surfaces.

* * * * *